US008553019B2

(12) United States Patent
Vogsland

(10) Patent No.: US 8,553,019 B2
(45) Date of Patent: Oct. 8, 2013

(54) SMART DISPLAY PIXEL

(75) Inventor: Robin O. Vogsland, Rio Rancho, NM (US)

(73) Assignee: Honeywell International Inc., Morristown, NJ (US)

( * ) Notice: Subject to any disclaimer, the term of this patent is extended or adjusted under 35 U.S.C. 154(b) by 120 days.

(21) Appl. No.: 13/248,080

(22) Filed: Sep. 29, 2011

(65) Prior Publication Data

US 2012/0013653 A1 Jan. 19, 2012

Related U.S. Application Data

(63) Continuation of application No. 11/505,757, filed on Aug. 17, 2006, now abandoned.

(51) Int. Cl.
*G09G 5/00* (2006.01)

(52) U.S. Cl.
USPC ..... 345/204; 345/214

(58) Field of Classification Search
USPC ..... 345/87–100, 204–215, 690
See application file for complete search history.

(56) References Cited

U.S. PATENT DOCUMENTS

| | | | | |
|---|---|---|---|---|
| 5,410,328 | A * | 4/1995 | Yoksza et al. | 345/82 |
| 7,071,620 | B2 * | 7/2006 | Devos et al. | 313/512 |
| 2005/0078115 | A1 * | 4/2005 | Buchmeier et al. | 345/502 |
| 2006/0077192 | A1 * | 4/2006 | Thielemans et al. | 345/204 |

* cited by examiner

*Primary Examiner* — Vijay Shankar
(74) *Attorney, Agent, or Firm* — Ingrassia Fisher & Lorenz, P.C.

(57) ABSTRACT

Construction of a pixel-based display using a set of pixel assemblies poured or placed into a display area or volume. Each pixel assembly has a means to produce a visible display output at its position and identify its own position within a 2-D or 3-D display space continuously or when needed. One or more image signals are distributed to the pixel assemblies collectively. Each pixel assembly uses its own self-detected position and other criteria to autonomously decide to which part of the signal(s) it will respond and what value to display as an output. Optionally each pixel assembly may also be able to: decode pixel identity encoded in the input signal(s) to implement a stroke/random access display; communicate with adjacent display elements in order to engage in collective action in local regions of the display; detect faults and remove itself from the display; and reprogram itself using an external signal.

17 Claims, 6 Drawing Sheets

SMART DISPLAY PIXEL

RELATED APPLICATIONS

This application is a continuation of U.S. patent application Ser. No. 11/505,757, filed on Aug. 17, 2006, which is incorporated herein by reference in its entirety.

BACKGROUND OF THE INVENTION

1. Field of the Invention (Technical Field)

The present invention relates to displays and more particularly to a method and apparatus for implementing pixels in a two or three dimensional volume and to provide individual pixel intelligence.

2. Background Art

Modern digital display devices commonly employ a two dimensional (2-D) array of pixel elements arranged in columns and rows. Each pixel typically contains a red, a green, and a blue element. Each sub-pixel or element is connected to one corresponding row wire trace and one column wire trace on the supporting substrate as shown in FIG. 1.

For a typical M×N pixel display, the image is constructed by first loading each of the 3N column drivers with a separate digital value corresponding to the color amplitude of the sub-pixel for the first row. Then 3N Digital-to-Analog converters transform these digital values to a corresponding analog voltage for each sub-pixel. Column wire traces route this signal to every sub-pixel in that column. After the analog data is ready, the first row wire is momentarily set to an enable state that causes only the sub-pixels in the first row to sample their input value while the other rows ignore the input. When thus enabled, the circuitry in each sub-pixel captures and holds the sub-pixel display value. Each sub-pixel is designed to transform the applied analog voltage to a visible display appearance. After row 1 is thus activated, the process repeats for row 2, then row 3 etc. The fill order, or even the roles of the rows and columns, may be reversed by the designer. In this way, two 1-dimensional arrays of control wires are used to drive a 2-D display.

The 2-D display described above can also be extended to 3-dimensions (3D) in at least two ways: 1) layering the 2D displays; or 2) true 3D fabrication. In either case, three 1-dimensional arrays are used to control the 3-dimensional display. FIG. 2 shows an implementation of a 3-D display of M×N×J pixels using layered 2-D displays. Each plane can be filled either in parallel or sequentially from the signal source. In a sequential implementation, the rastor scan is a 1-dimensional "row" (whose "columns" data is loaded in parallel for a single plane). The rastor scan steps through a 2-D pattern, first covering rows 1-M and then repeating to cover layers 1 through J. If the implementation allows all J layers to be loaded in parallel, the output scan shape becomes in effect, a plane that steps through a 1-D pattern to cover all "row" wireplanes in parallel.

FIG. 3 shows a more truly 3-D (more symmetric) implementation of a 3-D display with M×N×J pixels. In this case each 1 dimensional control array output signal is routed in two (2) dimensions to all subpixels in a plane. The three control arrays correspond to three orthogonal wireplanes that collectively can uniquely address each pixel. The scan shape for this display is a 1-D line of pixels (tied to the XZ wireplane driver array in FIG. 3) that must step through a 2-D scan pattern to render the 3-D display.

Such 2-D displays utilize complex two-dimensional mechanical structures normally consisting of substrates or superstrates with two or more individual electrical signal lines connected to each pixel to carry the image signal that is to be displayed. Implementing pixels in a 3-D volume is even more problematic, requiring a 3-D mechanical structure. Each of these structures consists of a multitude of microscopic elements fabricated within a relatively macroscopic matrix structure, which poses a difficult problem for fabrication and with inherent fragility that limits reliability of fabrication and operation.

The nature of the matrix also requires a complex external mechanism be used to first create the signal image as a whole and then decompose it into individual signals to be routed to each sub-pixel in sequence. In so doing, the matrix mechanism limits how the pixels can be controlled: Pixels must take turns with only one row for 2D or true 3D displays or one plane for layered 3D displays receiving a signal at any time. Because of this approach, the display update rates are limited by the time it takes to propagate the raster "scan shape" down one row or plane at a time in order to refresh all pixels.

The above-mentioned problems with conventional displays are inherent in most or all current mass-produced displays. The cost of fabricating the conventional display limits low-end display cost. The complexity and fragility of the fabricated display ensures that most displays will develop, when manufactured or subsequently during operation, one or more pixels that are defective and reduces the perfection of the display image.

Building larger displays can be approximated in some situations by using multiple independent smaller display assemblies. This can increase production yield, but does not reduce significantly the manufacturing precision requirements or fragility problems.

The display industry has spent decades solving these difficult manufacturing problems in order to manufacture higher resolution, larger displays with microscopic pixel elements embedded in a macroscopic matrix with sufficient repeatability to produce modestly priced, modestly reliable displays of a limited size.

For general purpose imaging displays, all manufacturers' design solutions seem to be similar. All solutions are aimed at meeting the challenge of performing the difficult mechanical fabrication as well as possible.

Some prior art references attempt to solve some of the problems raised above, but fail to accomplish a solution as disclosed in this patent application. These include U.S. Pat. No. 5,838,337, entitled "Graphic system including a plurality of one chip semiconductor integrated circuit devices for displaying pixel data on a graphic display" which teaches a method for storing graphic data and a circuit using the method which enables a higher-speed execution of dyadic and arithmetic operations on graphic data with a memory circuit which performs read, modify, and write operations in a write cycle so that the number of dynamic steps is greatly reduced in the software section of the graphic processing. This method supports a display device having a graphic display area, which includes a plurality of display portions and a plurality of one-chip semiconductor integrated circuit devices. Another prior art device is disclosed in U.S. Pat. No. 5,900,850 entitled "Portable large scale image display system". This device is a large scale, portable light emitting diode image display system including one or more display panels comprising a web or netlike structure, preferably formed of interconnected flexible foldable strap members arranged in plural vertical columns and horizontal rows. Yet another prior art device is disclosed in U.S. Pat. No. 6,237,290 entitled "High-rise building with large-scale display device inside transparent glass exterior". This invention is a high-rise building with a large-scale display device on its exterior consisting of a large scale display device which can be constructed inside the transparent glass exterior by installing multiple modules in rows and columns.

Because of their dependence on a row/column structure, the prior art approaches have similar problems for rendering a large display in a 3-D volume or 2-D displays in a non-rectangular shape. These problems include that prior art displays are very complex mechanically and require expensive, highly engineered manufacturing tooling and processes to produce acceptable yields for large displays and production of displays much larger than those currently available are desirable, but made costly or impractical by yield limitations as display resolution increases.

A number of undesirable design and manufacturing constraints are inherent to current techniques. These include:

a) precision manufacturing of microscopic elements in a macroscopic structure;

b) making pixels part of a large physically-monolithic matrix makes bad pixels in displays difficult to repair;

c) use of row-column encoding in the matrix to get the activation signal to each pixel means that the rest of the display is inaccessible while each raster set of the pixels is receiving its value. Such a display cannot directly accept stroke inputs or multiple inputs; and tends to have a lower maximum refresh rate.

d) it is difficult to flexibly omit portions of rows or columns in order to make a display that is not rectangular in shape.

Further, using the prior art techniques to implement pixels in a 3-D volume would require several extraneous elements, such as row, column wiring and potentially layer wiring to each pixel, row and column decoding circuits, and drivers that are located outside of the pixels themselves, and additional software and memory resources added to the image generator to support mixing signals from multiple sources.

There are no known displays that replace one or more of the wires routed individually to each pixel row or sub-pixel column with a signal that is available from a single source in common to all pixels or use internal pixel controls as provided in the present invention.

SUMMARY OF THE INVENTION

Disclosure of the Invention

The present invention is a departure from common display technologies presently in use which rely upon external means to determine how each pixel will respond to each part of a time-varying image signal. Examples of display types include light emitting diodes (LED) and liquid crystal displays (LCD), video raster displays, stroke displays such as analog oscilloscopes, advertising displays with lamps or elements controlled through dedicated point to point wiring and motion picture projection that uses external film to determine image appearance at each point of the image in parallel. The unique and new aspect of the present invention is the relocation of the pixel control "intelligence" from outside of the display material to the inside of the display material or the pixel itself. Each display element identifies its own position or pixel identification. The display signal can be injected into the signal-conducting display media from a single point without special decoding. Each pixel element's algorithm decides when to activate and the value to display. The algorithm can be enhanced to allow the display to modify itself if defined events occur in the display. This function is presently done in a display generator. The pixels can also be disabled and removed if they malfunction. Since each pixel is autonomous, each can be made programmable.

A primary object of the present invention is to eliminate the physical row and column (and layer) organization of displays and their attendant restrictions on display form, fabrication, and scan pattern.

The primary advantages of the present invention is that it simplifies the manufacture of certain displays, it allows unlimited novel display scales and shapes, and it allows single or multiple simultaneous scan patterns to be rendered in the display, including combinations of random access (stroke) scan patterns and rastorized scan patterns.

Other objects, advantages and novel features, and further scope of applicability of the present invention will be set forth in part in the detailed description to follow, taken in conjunction with the accompanying drawings, and, in part, will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

Figure 1:
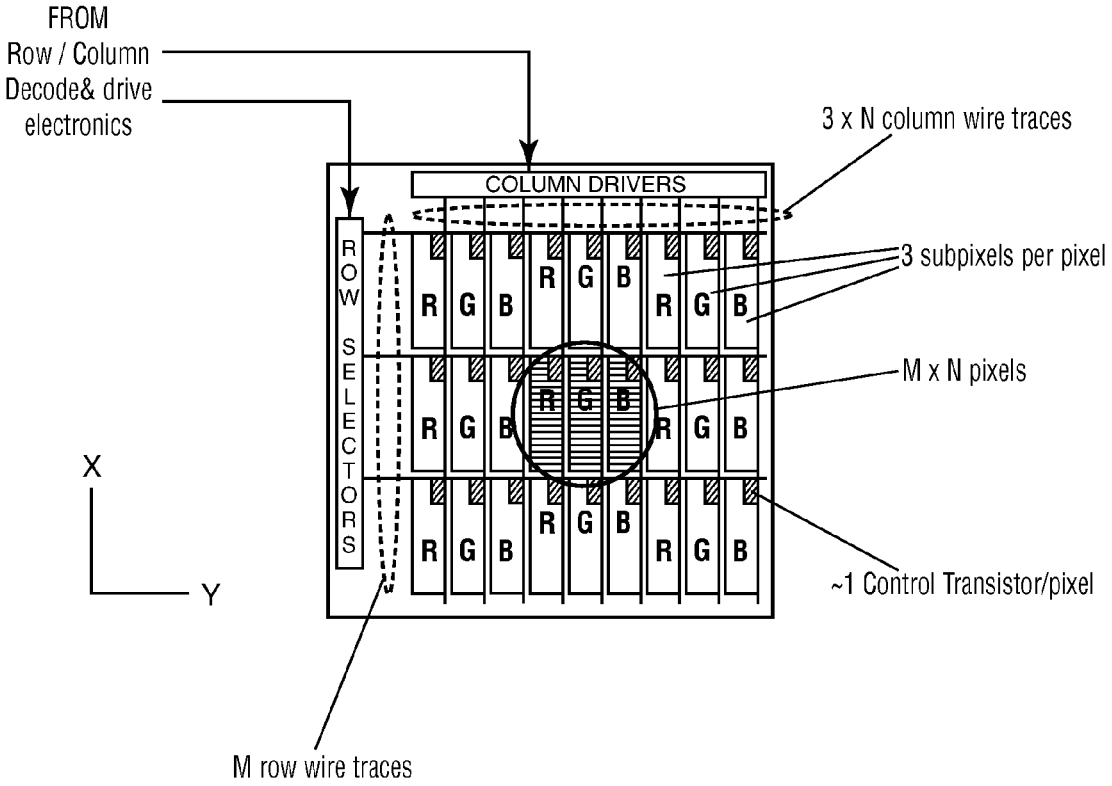
FIG. 1 Prior Art
FIG. 1 shows a typical prior art 2-D color display.
Figure 2:
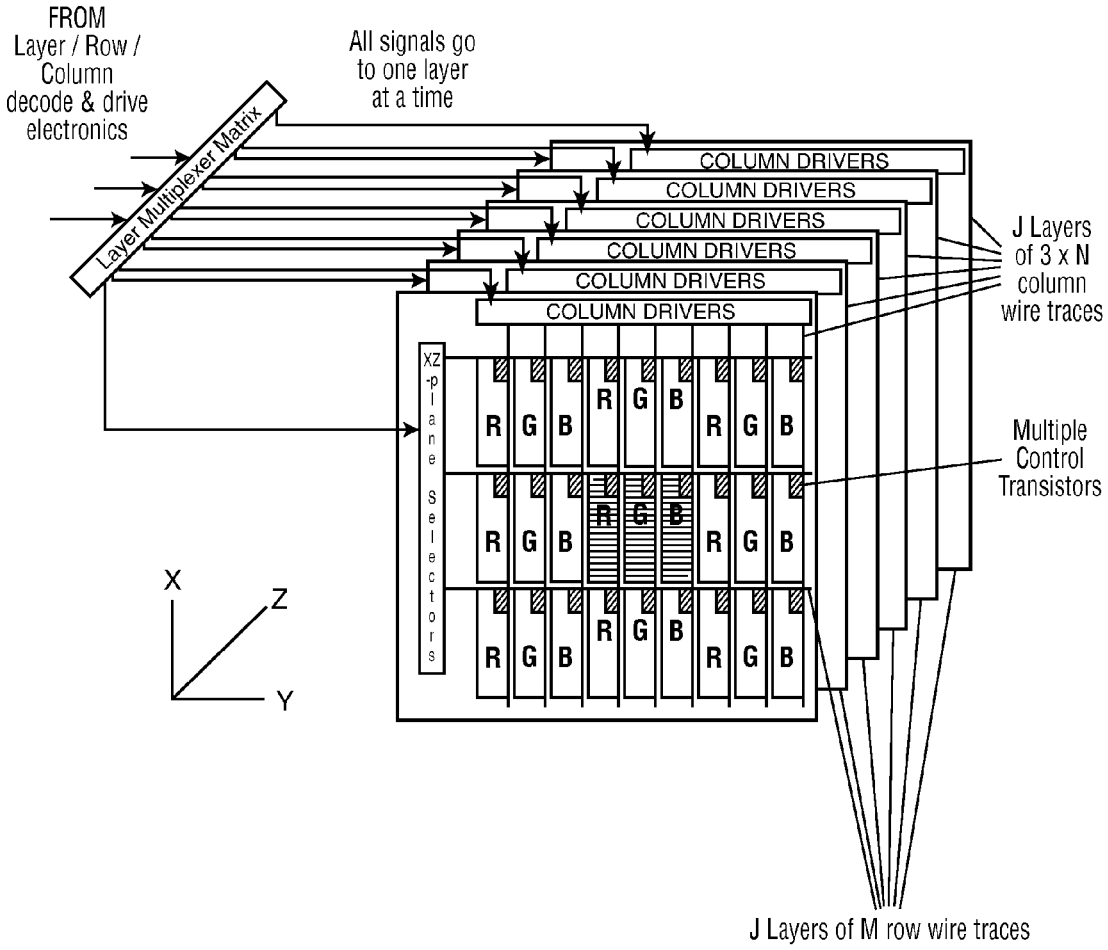
FIG. 2 Prior Art
FIG. 2 shows a prior art 3-D color display using a layering technique.
Figure 3:
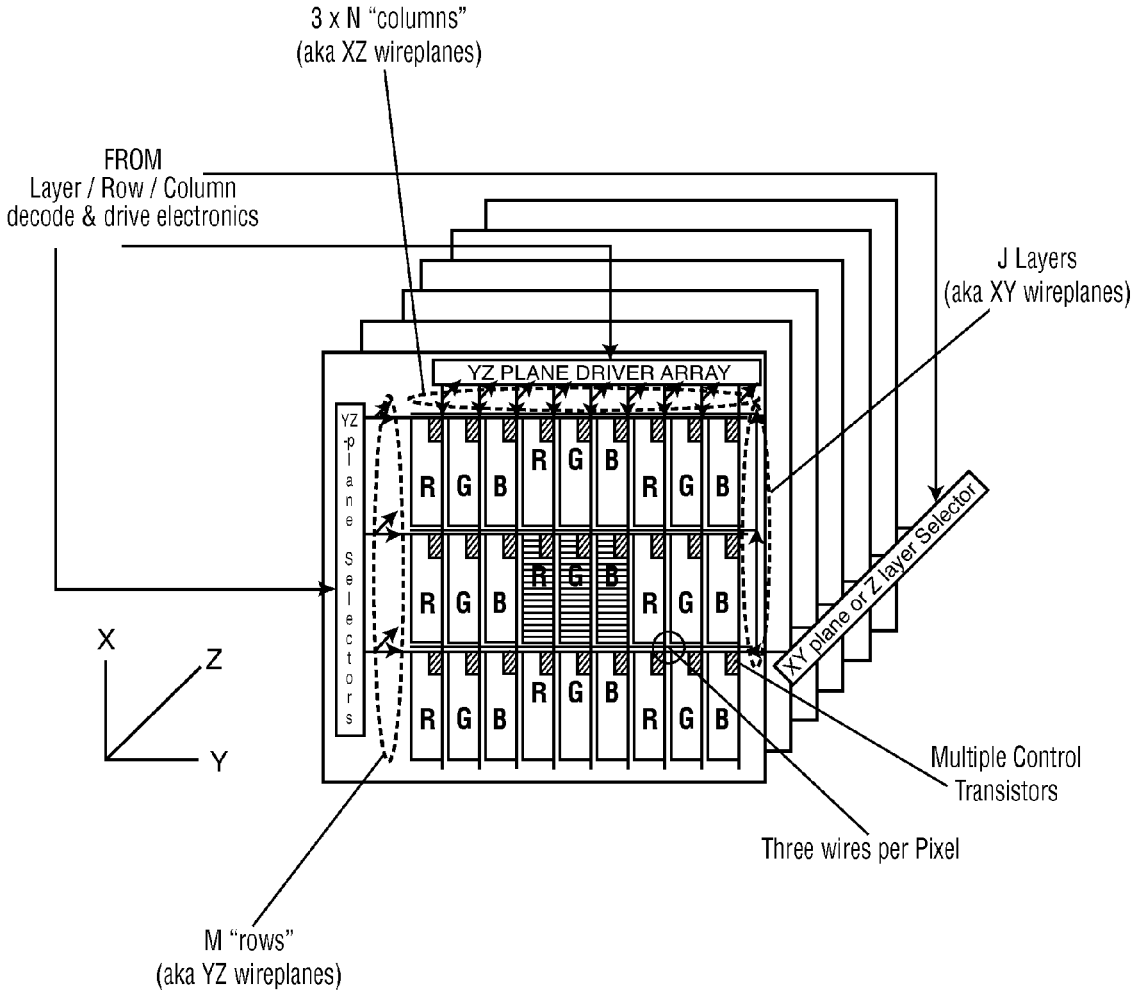
FIG. 3 Prior Art
FIG. 3 shows a prior art 3-D color display using true 3-D technique.
Figure 4:
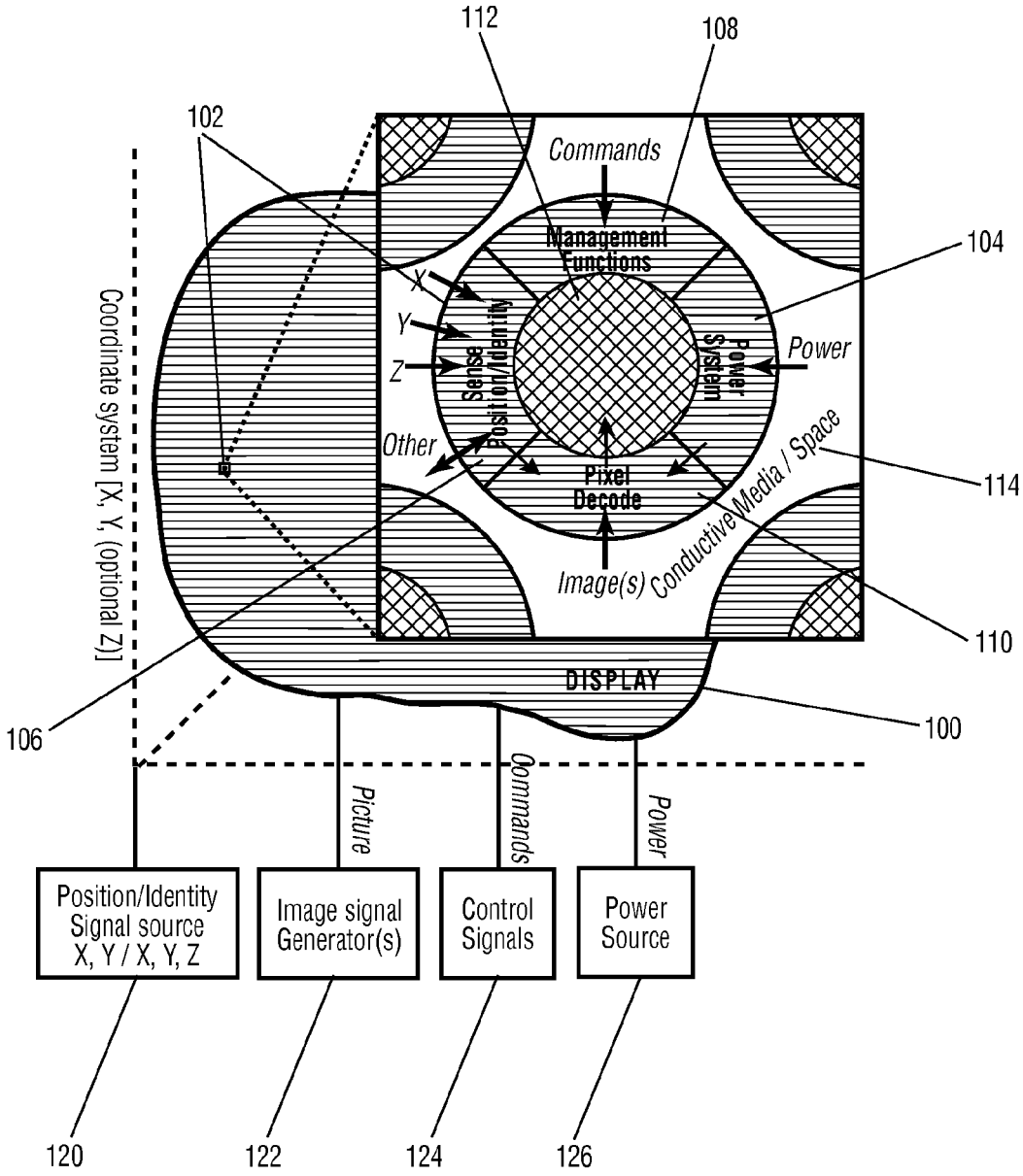
FIG. 4 shows a schematic of the generic functional elements of the preferred display.

The present invention is a novel apparatus and method for rendering displays; instead of commonly used methods of generating a display, the present invention makes each of the pixels internally intelligent. FIG. 4 shows the generic functional elements of the preferred display in a schematic depiction. A 2-D or 3-D display 100, with not-necessarily-rectangular sides is filled with a plurality of self-decoding pixel assemblies 102. FIG. 4 shows an exploded functional diagram of pixel assembly 102. The implementation technology of the pixel assembly 102 can encompass any available technologies including mechanical, micro-electromechanical, electronic, photonic, chemical, biological or other. Each pixel assembly 102 preferably has the means to obtain power from a power source 104 to operate the pixel and a positioning or identity sensor 106. Positioning or identity sensor 106 can be a sonic, electrical, electromagnetic, gravitational, pressure, or satellite navigation sensor to access absolute or relative position of pixels using a defined coordinate system. Pixel assemblies 102 may also contain similarly diverse types of output transducers to allow them to participate in cooperatively determining the relative positioning of the pixel set. Additionally, pixel assemblies 102 preferably have a management function structure 108 for receipt of control signals as needed to manage pixel operation. Some examples of management functions are: ON/OFF control, brightness control, contrast control, color control, control of pixel algorithm reprogramming, control means to coordinate action with adjacent pixels, Built-In-Test control and reporting, pixel repair/removal mode control, and other controls. Some of these may require additional input signals that are applied to the pixels. Pixel assemblies will also preferably have a pixel decoder 110 for decoding external image signals to determine the intended display state at the pixel's location and activate the pixel as required. The decoder may include multiple input channels to allow drawing of multiple simultaneous scans to the display. Since the pixels and display inputs may not precisely be aligned, the pixel decoder will preferably use an algorithm—nearest value, interpolation, or other—to assign the exact pixel value. The decoder 110 may also receive inputs from adjacent pixel transducers to allow cooperative action such as anti-aliasing, masking of dead pixels, special effect modes, localized special behavior and other functions. A pixel activator 112 is also preferably included to produce two or more observable or operative output states. Observable states may include on/off, greyscale-monochrome, color, and others. Operative states may include transparency/opacity states, reflectivity states, or transmissivity states that alter the flow or emission of visible or invisible electromagnetic radiation, particles, or fluids at the pixel location.

Each of the pixel assemblies 102 is disposed on/within one or more conductive media 114 which is used to convey the various external signals to the pixel assembly 102. All pixel assemblies 102 share the conductive media 114 without individual wiring from any external entity. Examples of the preferred conductive media 114 include conductive planes bounding pixel layers for analog or serial electrical signals, transparent material or vacuum for infrared or other electromagnetic transmission; solid or fluid material for electrical, sonic, fluid motion, biological, or chemical signals. Further, all pixels share a positional or identity signal source 120 which can be a coordinate system with X, Y, and optionally Z axes, for communicating with positioning or identity sensor 106 within the pixel. Positional or identity signal source 120 can be either external or emitted by the pixel assemblies 102 themselves. The system also preferably has one or more image signal generators 122 for providing one or more image signal sources. A power source 126 is also needed to provide power or energy to power the system 104. Power source 126 is nominally external to pixel assembly 102, but could be integrated into each pixel. The power source may be chemical, electrical, thermal, mechanical, solar, wind/fluid-flow, electromagnetic, magnetic, radioactive, energetic particle, or other well-known devices. Control signals 124 provide the desired behavior control for the pixel assembly 102 and may be received from a combination of external and inter-pixel sources as required.

Figure 5A:
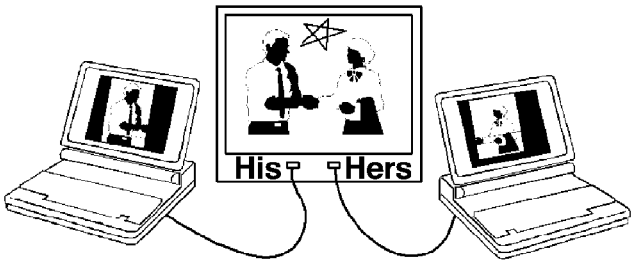
FIG. 5A shows use in a video or computer display.
Figure 5B:
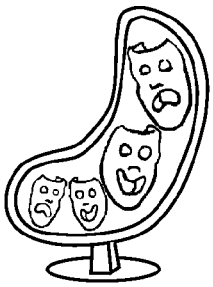
FIG. 5B depicts an irregular shaped display.
Figure 5C:
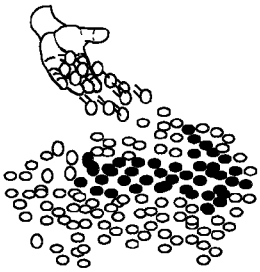
FIG. 5C shows a scattered pixel display.
Figure 5D:
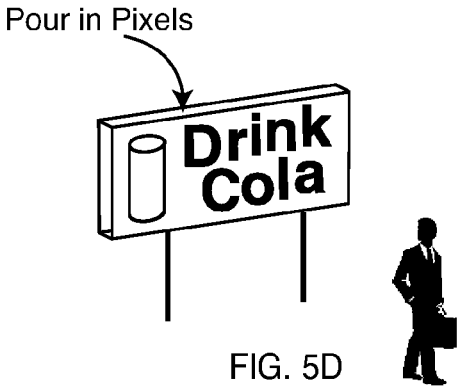
FIG. 5D shows a large display.
Figure 5E:
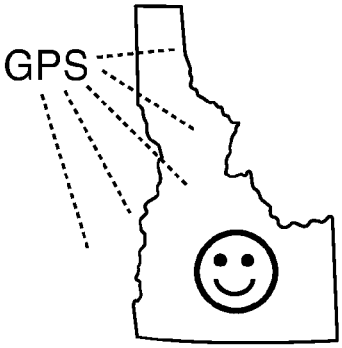
FIG. 5E shows a very large display that encompasses square miles of area.
Figure 5F:
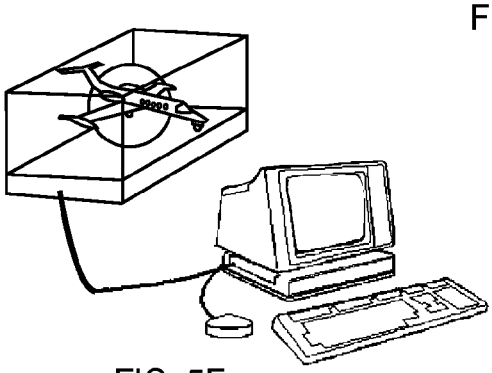
FIGS. 5F and 5G show two types of 3-D displays.
Figure 5G:
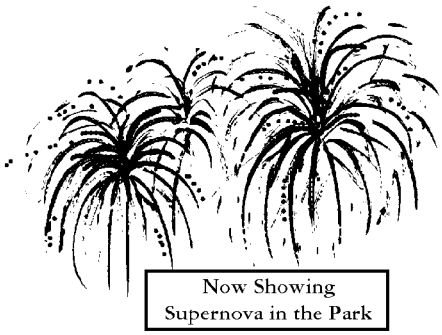

With the abolition of individual wiring to pixels as defined in this invention, displays can be of any size from square micro-inches to square miles. Many embodiments of this invention are possible depending on the size and the optical and performance characteristics desired. Examples of these embodiments are: FIG. 5A shows use in video or computer displays. This embodiment can include multiple inputs and mixed stroke and raster displays. FIG. 5B depicts an irregular shaped display. FIG. 5C shows a scattered pixel display. FIG. 5D shows a large display and FIG. 5E shows a very large display that encompasses square miles of area. FIGS. 5E and 5F show two types of 3-D displays. Each of these embodiments uses the aforementioned internal intelligent pixel configuration and design.

Figure 6A:
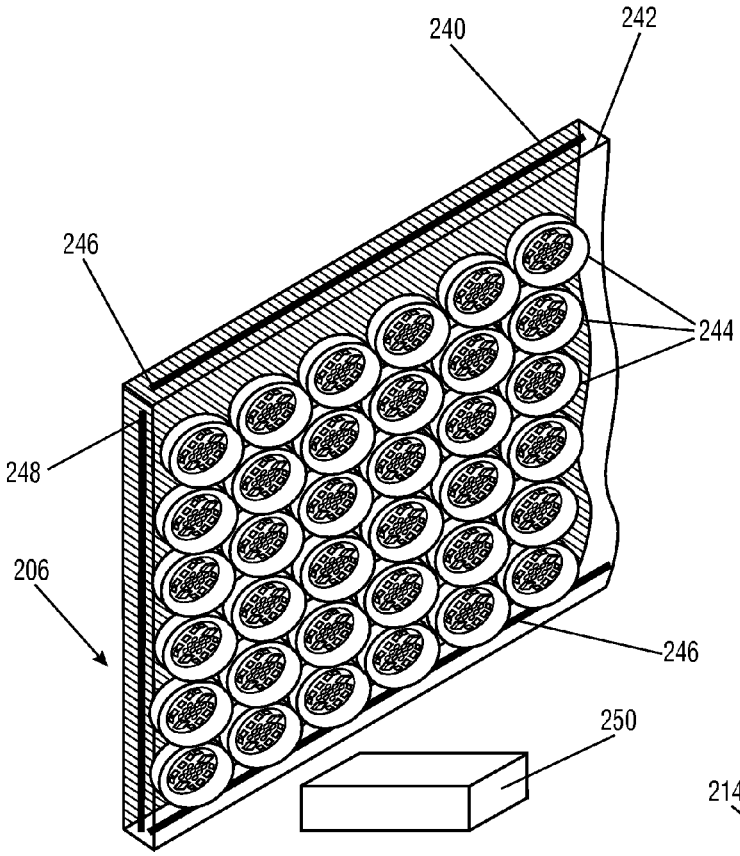
FIG. 6A shows a preferable construction of a billboard-scale display.
Figure 6B:
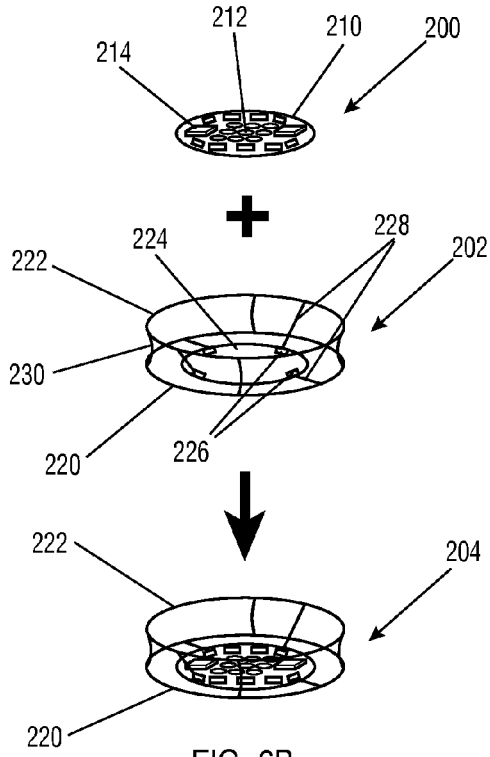
FIG. 6B depicts the preferable carrier for the billboard display of FIG. 6A.

An example of the present invention is shown in FIG. 6, the construction of a billboard-scale display. FIG. 6 shows how individual pixels 200 could be constructed and used in a billboard-scale display in accordance with this invention. A printed circuit board (PCB) 210 supports light emitting diodes 212 to act as red-green-blue sub-pixels. Circuitry components 214 mounted on PCB 210 include all electronics and ultrasonic sensors.

A carrier 202 is used to provide the remaining electrical and mechanical elements of an autonomous pixel 200. A lower rim 220 of the carrier 202 is a conductor that serves as a return. A similar upper rim 222 serves as the primary input signal conductor. A mounting plate 224 receives and holds the PCB 200 in contact with carrier pads 226 bonded via conductors 228 to the upper 222 and lower 220 rims. A spring insulator 230 holds the upper 222 and lower rims 220 apart but allows them to be squeezed together. A complete pixel assembly 204 is formed when PCB 200 and carrier 202 are combined as shown. The components of the carrier 202 may be designed to separate from each other and from the pixel assembly 200 when the pixel assembly 200 (or external maintenance equipment) initiates a pixel destruct action to allow the pixel to drop out of its position in the display.

Multiple pixels 244 are inserted into billboard assembly 206. Billboard assembly 206 consists of two conductive plates. Rear plate 240 is a conductor. Front plate 242 is a transparent or partially transparent conductive plate. The two plates 240, 242 carry power, image signal and control signals. A pair of linear ultrasonic transducers 246 on the top and bottom of the display area emits sonic pulses from opposite sides of the display as reference signals that each pixel assembly 204 uses to determine its vertical position in the display. A similar pair of transducers 248 on the ends of the display is used to sense horizontal position. A control box 250 provides power and image signals to the billboard rear plate 240 and front plate 242 and position timing signals to the ultrasonic transducers 246, 248 and the image signal.

Multiple pixels 244 are squeezed between the plates 246, 248 so that the upper rim 222 and lower rim 220 contact the rear conductor plate 240 and front conductor plate 242. Common power from the plates 240, 242 energizes the pixel assemblies 204. The image signal is similarly delivered to all pixel assemblies 204 electrically. Each ultrasonic transducer 240, 248 in each axis emits coded pulses that the pixel assembly 204 times to assess its position. Each pixel assembly 204 monitors the video signal (e.g. raster or stroke with embedded XY tags) and turns on and holds the image value appropriate to the XY position of each individual pixel assembly 204. Each pixel assembly 204 does this independently. The pixel assembly 200 may be designed to include built-in-test capability to detect malfunctions and means to initiate mechanical breakup of the combined pixel so that its components fall to the bottom of the display and its place is filled in by the settling of other pixels 244. The mechanization of the position detection means, power means, image signal transmission means, and pixel control means are incidental to the operation of the invention. This display embodiment may be altered to create spherical or other pixel configurations to create a 3-D volume display.

The present invention supports displays that accept multiple independent image input sources and display them simultaneously. It also supports displays with random access and stroke input capability to allow pixels to be activated in a non-raster fashion. This capability can be supported in combination with one or more simultaneous raster inputs. Pixel visual mechanisms can use any means to create a visible image, including light emitting, light filtering, light absorbing, light reflecting using electrical, chemical, electromechanical, and mechanical or other means. Because there is no physical row-column wiring, the display can have multiple novel attributes including regular, irregular or variable-shapes; fixed/variable pixel-density; and contiguous/discontiguous areas. Construction of the display may include fixed (fabricated-in-place) pixels or movable, interchangeable pixels including pixels that have fluid-like properties that can be "poured" or "pressed" into a 2- or 3-dimensional cavity. Optionally, such fluid-like pixels can be designed to self-destruct or otherwise remove themselves from the display if they fail so that their place can be automatically filled by another pixel. This invention includes displays that do not require a precision substrate or any substrate. A large display can be made by suspending autonomous pixels on a simple fiber mesh. Substrate-less displays can be created by simply scattering autonomous pixels on a surface or by floating pixels in water, air, or space, etc. Displays of any scale can be created. Standalone pixels using batteries, solar or other power sources and radio positioning and image signals could be used to create outdoor displays. Integrated circuits can be used to create desktop and television-scale 2-D and 3-D displays. With the advent of suitable micro-electromechanical, molecular, or atomic-scale circuitry fabrication techniques, higher density and smaller displays can be fabricated.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An operably moveable autonomous pixel for a display device, the pixel comprising:

a means for the operably moveable autonomous pixel to obtain power from a power source regardless of a present location of the operably movable autonomous pixel;

a pixel identifier configured to unilaterally determine the present location of the operably moveable autonomous pixel; and a controller within the operably moveable autonomous pixel configured to internally actuate said operably moveable autonomous pixel based on data from the pixel identifier and an image signal source.

2. The operably moveable autonomous pixel of claim 1, wherein the power source is a single common conductive media internal to the display device for all pixels in the display device.

3. The operably moveable autonomous pixel of claim 1, wherein the power source is external to the display device.

4. The operably moveable autonomous pixel of claim 3, wherein the power source is solar energy.

5. The operably moveable autonomous pixel of claim 3, wherein the power source is selected from a list consisting of a chemical, thermal, mechanical, fluid flow, wind, magnetic, radioactive and energetic particle power source.

6. The operably moveable autonomous pixel of claim 1, wherein the pixel identifier determines the current location of the moveable autonomous pixel directly from a signal broadcast simultaneously and directly to all pixels in the display device.

7. The operably moveable autonomous pixel of claim 1, wherein the moveable autonomous pixel receives an image signal broadcast simultaneously and directly to all pixels in the display device.

8. The moveable autonomous pixel of claim 1, wherein the moveable autonomous pixel receives one or more control signals, the function of the control signals being chosen from a list consisting of setting an ON/OFF state, setting pixel brightness, setting pixel contrast, controlling pixel reprogramming, coordination with other operably moveable autonomous pixels, controlling built-in-tests, setting color qualities, and controlling pixel repair.

9. An operably moveable autonomous pixel for a display device, the pixel comprising:

a means for the operably moveable autonomous pixel to obtain power from an external power source regardless of a present location of the autonomous pixel;

a pixel identifier configured to unilaterally determine the present location of the operably moveable autonomous pixel; and a controller within the operably moveable autonomous pixel configured to internally actuate-said autonomous pixel based on data from the pixel identifier and an image signal source.

10. The operably moveable autonomous pixel of claim 9, wherein the power source is a single common electrically charged conductive media internal to the display device for all pixels in the display device.

11. The operably moveable autonomous pixel of claim 9, wherein the power source is external to the display device.

12. The operably moveable autonomous pixel of claim 9, wherein the controller is independently programmable.

13. The operably moveable autonomous pixel of claim 9, wherein the present location of the pixel is an absolute location in regard to a reference frame.

14. The operably moveable autonomous pixel of claim 9, wherein the present location of the pixel is a relative location in reference to another autonomous pixel.

15. The operably moveable autonomous pixel of claim 9, wherein the conductive media used for the autonomous pixel to obtain power from an external power source is selected from a group of media consisting of a transparent material, a vacuum, and a fluid material, wherein the transparent material, the solid material, the vacuum, and the fluid material transmits one of a sonic, fluid motion, biological and chemical signals.

16. A method of activating an operably moveable autonomous pixel for a display, the method comprising the steps of:

a) providing power to the operably moveable autonomous pixel;

b) determining a location of the operably moveable autonomous pixel within the display;

c) providing an image signal to the operably moveable autonomous pixel that encodes an image value as a function of location within the display; and d) internally activating the operably moveable autonomous pixel based on the step of determining a location and the step of providing the image signal.

17. The method of claim 16, wherein the method of activating an operably moveable autonomous pixel includes providing control signals, the function of the control signals being chosen from a list consisting of setting an ON/OFF state, setting pixel brightness, setting pixel contrast, controlling pixel reprogramming, coordination with other operably moveable autonomous pixels, controlling built-in-tests, setting color qualities, and controlling pixel repair.

* * * * *